United States Patent [19]

Naruki

[11] Patent Number: 5,000,596

[45] Date of Patent: Mar. 19, 1991

[54] TRAY ASSEMBLY OF A PRINTER

[75] Inventor: Kenichi Naruki, Fukuyama, Japan

[73] Assignee: Mitsubishi Denki Kabushiki Kaisha, Tokyo, Japan

[21] Appl. No.: 338,084

[22] Filed: Apr. 14, 1989

[30] Foreign Application Priority Data

May 10, 1988 [JP] Japan ..... 63-112831

[51] Int. Cl.[5] ..... B41J 11/58

[52] U.S. Cl. ..... 400/625; 400/624; 400/629; 271/9; 271/902

[58] Field of Search ..... 400/624, 625, 626, 628, 400/595, 607, 607.2, 634, 642, 647, 120 MP, 629; 271/9, 902

[56] References Cited

U.S. PATENT DOCUMENTS

| | | | |
|---|---|---|---|
| 4,547,783 | 10/1985 | Watanabe | 400/120 |
| 4,552,470 | 11/1985 | Yana et al. | 271/902 |
| 4,607,834 | 8/1986 | Dastin | 271/223 |
| 4,645,195 | 2/1987 | Scranton et al. | 271/902 |

FOREIGN PATENT DOCUMENTS

| | | | |
|---|---|---|---|
| 0242085 | 12/1985 | Japan | 400/624 |
| 154866 | 7/1986 | Japan . | |

OTHER PUBLICATIONS

IBM Tech. Disclosure Bulletin, vol. 24, No. 12, May 1982, by Wilson & Wilzbach.

*Primary Examiner*—Edgar S. Burr
*Assistant Examiner*—Ren Yan
*Attorney, Agent, or Firm*—Sughrue, Mion, Zinn, Macpeak and Seas

[57] ABSTRACT

A tray assembly for a full color thermal transfer type printer is disclosed. The printing mechanism of the printer including a roller platen moves the sheet of printing paper under printing several times forward and backward to effect a full color printing. The tray assembly comprises a discharge tray at the top, a paper guide formed integrally thereunder, and a manual feed tray detachably attached to the underside of the paper guide. The paper guide form an extension of the return paper passage of the printer into which the sheet of paper enters when it is moved backward. The tray assembly further comprises a pair of plate-shaped adapters detachably attached to the interior sides of the side walls of the manual feed tray; thus, the interior side surfaces of the adapters determine, when attached to the manual feed tray, the lateral position of the sheet of paper fed into the printer from the manual feed tray. When the manual feed tray is used without the adapters, the interior side surfaces of the side walls of the manual feed tray determine the lateral position of a manually fed sheet of paper.

6 Claims, 3 Drawing Sheets

TRAY ASSEMBLY OF A PRINTER

BACKGROUND OF THE INVENTION

This invention relates to printers such as thermal transfer type printers, and more particularly to a tray assembly of printers in which a sheet of printing paper is moved forward and backward over a roller platen several times to effect a full color printing.

Recently, thermal transfer type printers have come into wide use, in which a thermal head is pressed against a sheet of printing paper supported on a roller platen to transfer dye materials carried on an ink sheet or ribbon to the sheet of paper. Some of these thermal transfer type printers are capable of printing full color images; in such case, a sheet of printing paper must undergo several printing operations in each of which a different primary color is printed thereon so that several primary colors are superposed on each other to produce a full color image. In some of these full color printers, the sheet of paper undergoing printing operation is moved forward and backward several times over the roller platen to effect a superposition of several primary colors.

FIG 1 shows a conventional printer disclosed in Japanese Laid-Open Patent Application No. 61-154866. The structure of this printer is as follows: To the main body 1 of the printer is detachably attached a paper cassette 3 accomodating sheets of printing paper 2 therein; the sheets of paper 2 are fed from the cassette 3 one by one. An ink sheet 4 carries dye materials thereon that are transferred to the sheet of paper 2*a* under the printing operation; to effect the transfer, a thermal head 5 is pressed against the roller platen 6 with the sheet of paper 2*a* and the ink sheet 4 interposed therebetween. The roller platen 6 opposes the thermal head 5 and rotates in the forward direction (i.e. clockwise as viewed in the figure) during a printing operation to move the sheet of paper 2*a* forward (toward left in the figure), and in the backward direction during the time when the sheet of paper 2*a* under printing is moved backward to the initial printing position. Sheets of paper which are fed manually are supplied from the manual feed tray 7 detachably attached to the main body 1 of the printer. Sheets of printing paper which have been printed with the primary colors are received in the discharge tray 8 which is also detachably attached to the main body 1 of the printer. A feed roller 9 rotates in the direction indicated by the arrow to feed the sheets of paper 2 in the cassette 3 one by one to the printing mechanism including the platen 6. The pair of forwarding rollers 10 are disposed between the feed roller 9 and the roller platen 6 to forward sheets of paper either from the cassette 3 or from the manual feed tray 7. A pair of discharge rollers 11 are disposed to discharge the sheets of paper which has finished printing of the primary colors to the discharge tray 8. The sheet of paper 2*a* under printing is moved forward during printing of a primary color into the front paper passage 12; it is moved backward into the return paper passage 13 when it is returned to the position at which the printing of the next color is started. The direction of the first guide plate 14 is determined according as a sheet of paper is being fed or moved backward by the roller platen 6 rotating in the backward direction. The second guide plate 15 is disposed in the front paper passage 12 to guide the sheet of printing paper 2*a* which has finished printing operations to the discharge tray 8.

Next, the operation of the printer of FIG. 1 is supplemented. When a sheet of paper is fed from the paper cassette 3 or the manual feed tray 7, the first guide plate 14 is changed-over to secure the passage for the sheet of paper to the roller platen 6 in response to a signal from a paper sensor (not shown); the sheet of paper is thus fed to the roller platen 6. Thereafter, the thermal head 5 is pressed on the roller platen 6, the sheet of paper 2*a* and the ink sheet 4 being interposed therebetween. Thus, images, such as characters and figures, are printed on the sheet of paper 2*a* wrapped around the roller platen 6 in response to a signal from a figure processing device implemented in a microcomputer (not shown); namely, the dye material carried on the ink sheet 4 is selectively transferred to the sheet of paper 2*a* in accordance with the signal from the figure processing device. During a printing operation, the sheet of paper 2*a* is moved to the left in the figure and the front end portion of the sheet of paper 2*a* is thus moved into the front paper passage 12.

In the full color printing, three primary colors, e.g. yellow, magenta, and cyan, must generally be superposed on each other on the sheet of paper 2*a* at predetermined densities to obtain desired colors; thus, the above printing operation must be repeated several times. As a result, when a printing operation of a first primary color is over, the thermal head 5 is raised from the roller platen 6, and, forwarding the ink sheet 4 to the inital position at which the front end of the next primary color lies thereon, the roller platen 6 is rotated in the reverse direction to move the sheet of paper 2*a* under printing backward into the return passage 13 to the position at which the printing of the next primary color is started. The printing of the next color is effected thereafter in a way similar to the printing of the first primary color discribed above. By the way, when the sheet of paper 2*a* under printing is moved backward, the first guide plate 14 is changed over the guide the end portion of the sheet of paper 2*a* to the return paper passage 13.

Thus, the printing operations are repeated a number of times equal to the number of primary colors; the sheet of paper 2*a* which has finished these printing operations is discharged by the discharge rollers 11 to the discharge tray 8, following the course determined by the changed-over second guide plate 15.

The tray portion of the above printer have the following disadvantages. Namely, the manual feed tray 7 and the discharge tray 8 form separte parts which are detachably attached to the main body 1 of the printer 1 independently of each other; thus, the attachment portions of these tray 7 and 8 have structural weakness, and are prone to failures. Further, the paper return passage 13 is formed within the main body 1 of the printer; thus, the length of the passage 13 is limited by the dimension of the main body 1; it is therefore difficult to form a return passage 13 long enough to accomodate sheets of paper of longer sizes.

In view of the above disadvantages of the trays of the printer of FIG. 1, a structure of the printer shown in FIG. 2 has been developed, wherein the manual feed tray 7 and the discharge tray 8 are formed integrally to enhance its structural strength; further, the paper return passage 13 is extended to the extension passage in a paper guide 18 formed between the trays 7 and 8. (In FIG. 2, the reference numerals 1 through 13 represent parts or portions similar to corresponding parts or portions in FIG. 1.) The trays 7 and 8 and the paper guide 18 constitute an integrally formed tray assembly.

The tray assembly of FIG. 2, however, also suffers from problems. Namely, the size of printing paper used in printing is not always the same; it may differ from one set of sheets of paper to next. The size of the manual feed tray used in each occasion must be adapt to these sheets of paper of various sizes. Thus, the whole tray assembly, including the discharge tray 8 and the guide 18, must be moulded separately according to the paper sizes. The necessity of moulding a number of whole tray assemblies adapted to different paper sizes results in a high cost of production.

SUMMARY OF THE INVENTION

The primary object of this invention is therefore to provide a tray assembly for use with a full color thermal transfer type printers which is structurally strong, allows room for extending the paper return passage, and yet is adaptable to different sizes of sheets of printing paper.

It is an additional object of this invention to provide such a tray assembly which is inexpensive.

It is a further object of this invention to provide such a tray assembly which is easy to handle and wherein the adaptation to different sizes of paper can be effected easily and quickly.

The above objects are accomplished in accordance with the principles of this invention in a tray assembly comprising a disharge tray, a paper guide integral therewith, a manual feed tray detachably attached to the underside of the paper guide, and a pair of plate-shaped adapters detachably attached to the manual feed tray. The printer to which the tray assembly is attached moves the sheet of printing paper under printing forward and backward during the printing operations, to effect a full color printing, as described above. The printer thus comprises a return paper passage into which the sheet of paper enters which is moved backward in the steps of operation in which the sheet of paper is returned to the print starting position. The paper guide of the tray assembly forms an extension of this return paper passage. The pair of plate-shaped adapters are attached to the interior side surfaces of the side walls of the manual feed tray; thus, the interior side surfaces of the adapters, when attached to the mannual feed tray, determines the lateral position of the sheet of paper that is fed into the printer from the manual feed tray.

BRIEF DESCRIPTION OF THE DRAWINGS

The features which are believed to be characteristic of this invention is set fourth with particularity in the appended claims. This invention itself, however, both as to its structure and operation, may best be understood from the detailed description of the preferred embodiment taken in connection with the accompanying drawings, in which:

In the drawings. like reference numerals represent like or corresponding parts or portions.

DETAILED DESCRIPTION OF THE PREFERRED EMBODIMENT

Figure 2:
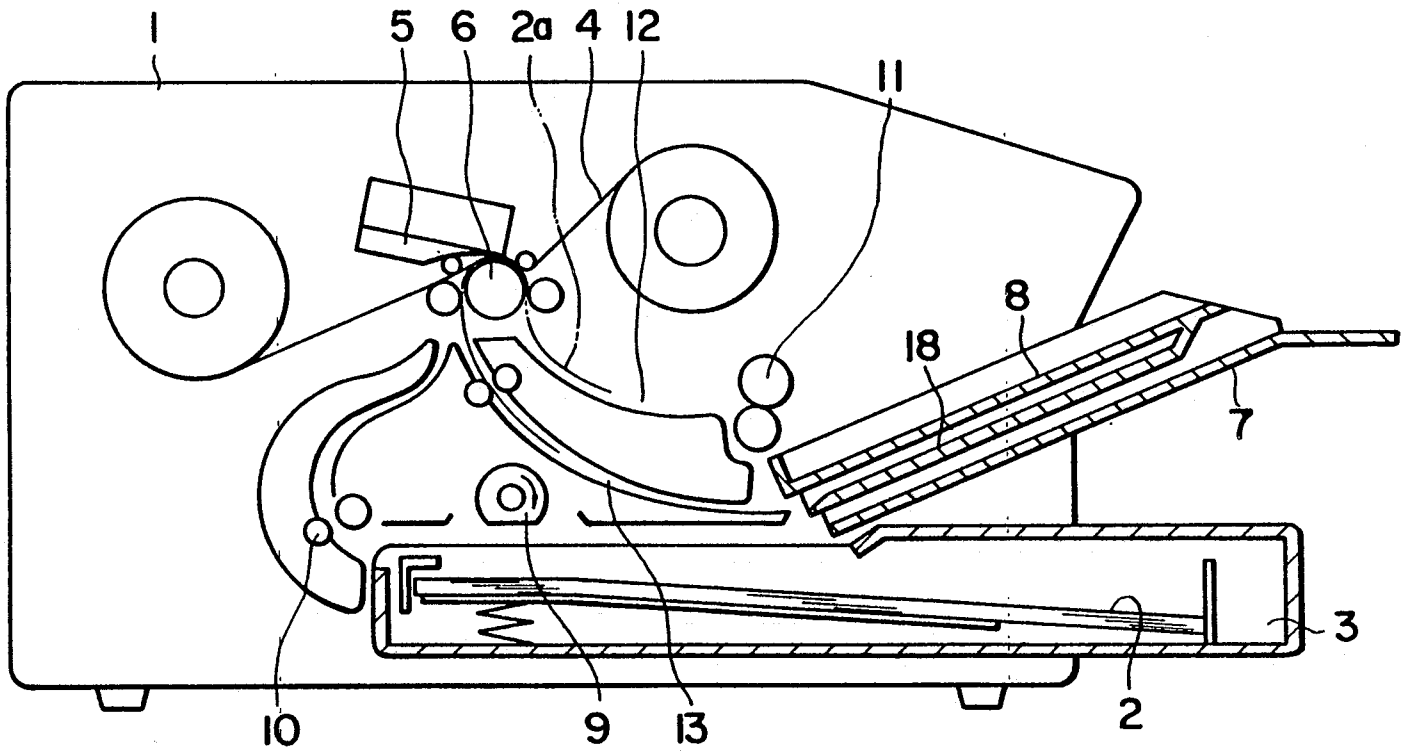
FIG. 2 PRIOR ART
FIG. 2 is a view similar to that of FIG. 1, but showing a printer comprising an integrally formed tray assembly, which is related to this invention.
Figure 3:
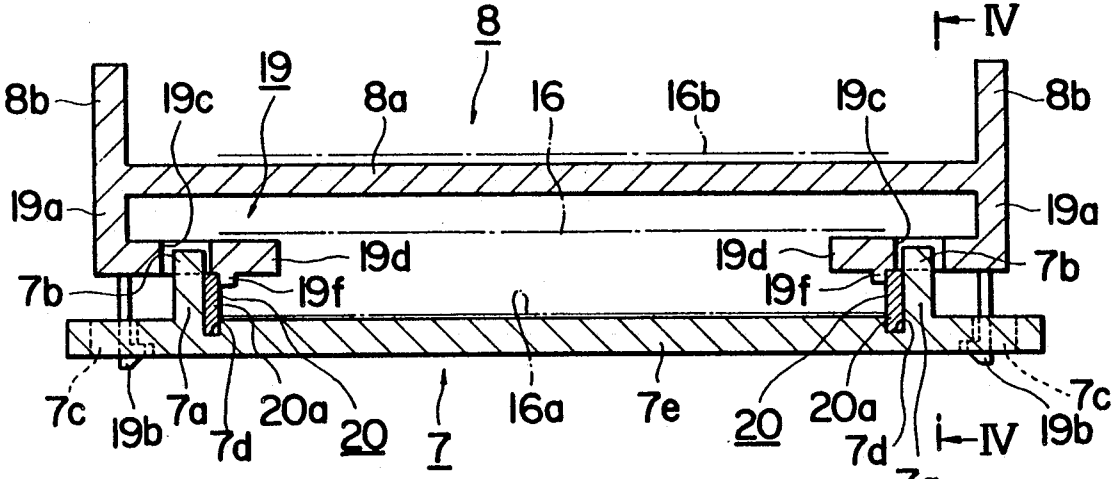
FIG. 3 is a sectional end view of a tray assembly according to this invention which may be used with the printer shown in FIG. 2, the view showing its section along line III—III in FIG. 4.
Figure 4:
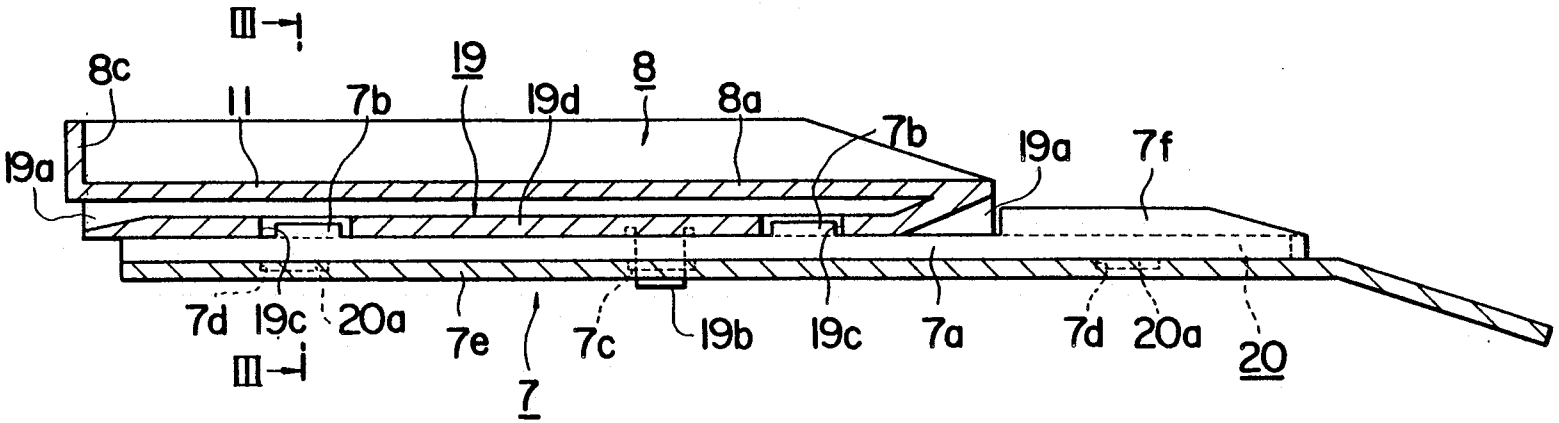
FIG. 4 is a sectional side view of the tray assembly of FIG. 3, showning its section along line IV—IV in FIG. 3.

Referring now to FIGS. 3 and 4 of the drawings, a tray assembly according to an embodiment of this invention is described. Before beginning the description thereof, it is noted that a tray assembly according to this invention shown in FIGS. 3 and 4 has, when assembled, a form substantially similar to that of the integrally formed tray assembly in FIG. 2 consisting of the trays 7 and 8 and the guide 18; thus, the tray assembly of FIGS. 3 and 4 may be attached to and used with the printer of FIG. 2, instead of the integral tray assembly thereof.

The tray assembly of FIGS. 3 and 4 comprises four portions: a discharge tray 8 at the top, a paper guide 19 formed under the tray 8 to be integral therewith, a manual feed tray 7 detachably attached to the underside of the paper guide 19, and a pair of plate-shaped adapters 20 detachably attached to the interior of the manual feed tray 7. In the following, these portions are described in the above order.

The discharge tray 8 comprises a bottom plate 8*a*, a pair of side walls 8*b* formed at both sides of the bottom plate 8*a*, and an end wall 8*c* formed at teh front end (i.e. the left end in FIG. 4) of the bottom plate 8*a*. Thus, the discharge tray 8 is open at the top and at the rear side. The rear end portion of the side walls 8*b* are slanted downward, as shown in FIG. 4, for easier handling of the discharged sheets of paper. By the way, the position of a discharged sheet of paper is indicated by a dot an dash line 16*b* in FIG. 3.

The paper guide 19, which corresponds to the guide 18 of FIG. 2, and, when the tray assembly of FIGS. 3 and 4 are attached to the printer of FIG. 2, forms an extension passage for the paper return passage 13 thereof, comprises a pair of side walls 19*a* each forming an extension of the respective one of the side walls 8*b* of the discharge tray 8, and a pair of horizontal extensions 19*d* extended horizontally inward toward each other; thus, the side walls 19*a* and the horizontal extensions 19*d*of the guide 19 form at each side an L-shaped integral extension of the wide walls 8*b* of the discharge tray 8. At the bottom of the guide 19 is thus formed an opening defined at each leteral sides by the interior sides of the horizontal extension 19*d*; the sheet of paper which is moved backward (i.e. toward right in FIG. 4) in a paper returning operation is guided on the horizontal extensions 19*d*. The position of the sheet of paper in the guide 19 is indicated by a dot and dash line 16 in FIG. 3. The front end of the horizontal extensions 19*d* are slanted downward toward the front, to provide an easier entrance for the returned sheet of paper 16; the rear end portion of the horizontal extensions 19*d*, on the other hand, are bent upward to be joined to the bottom plate 8*a* of the discharge tray 8 (see FIG. 4). Further, the guide 19 is provided with structures for the attachment of the manual feed tray 7 described below. Namely, a substantially plate-shaped dowel 19*b* of an elastic material having a hook-shaped enlarged top is formed on the underside of each horizontal extension 19*d* (or rather under each side wall 19*a*) to extend vertically downward therefrom. Further, a pair of rectangular holes 19c are formed in each horizontal extension 19d to extend vertically therethrough horizontally in alignment with side walls 7a of the manual feed tray 7 described below. The above discharge tray 8 and the return paper guide 19 are formed integrally of a synthetic resin by a moulding process, etc.

The manual feed tray 7 comprises a bottom plate 7e and a pair of side walls 7a formed a predetermined distance laterally inward from the lateral sides of the bottom plate 7e, The bottom plate 7a has a width slightly greater than that of the discharge tray 8 and the guide 19. On the other hand, the longitudinal length of the bottom plate 7e is substantially longer than that of the bottom plate 8a of the discharge tray 8; thus, the rear end portion of the bottom plate 7e of the manual feed tray 7, when attached to the guide 19, extends backward (to the right in FIG. 4) from the rear end of the tray 8 and the guide 19. The rear half of the rear end portion of the manual feed tray 7 extending from the discharge tray 8 and the guide 19 is bent downward for easier insertion of a sheet of printing paper into the tray 7. Side walls 7a of the manual feed tray 7 each have a pair of rectangular projections 7b extending vertically upward from the top surface thereof horizontally in registry with the rectangular holes 19c formed in the horizontal extensions 19d of the guide 19; the dimensions of these projections 7b are such that they fit into respective holes 19c to determine the position of the manual feed tray 7 with respect to the guide 19 and the tray 8. The rear end portion 7f of the side walls 7a, which lies outside of the guide 19 when the tray 7 is attached thereto, has a height substantially greater than that of their portions under the guide 19. Further, a stepped hole 7c each is formed in each portion of the bottom plate 7e extending sideways outward from respective one of the side walls 7a; each stepped hole 7c extend vertically through the bottom plate 7e, being horizontally in registry with the associated one of the pair of dowels 19b formed on the horizontal extensions 19d of the guide 19. Thus, when the manual feed tray 7 is attached to the underside of the guide 19. the dowels 19b extend into the stepped holes 7c, the hook-shaped englarged top of the dowels 19b engaging with the stepped portion of the stepped holes 7c. By the way, at the bottom of the interior side of each side walls 7a are formed a pair of rectangular recesses 7d, into which projections 20a of an adapter 20 are fitted as described below.

The pair of plate-shaped adapters 20 each have a length substantially equal to that of the straight portion of the bottom plate 7e of the manual feed tray 7. The adapters 20 each comprise a a pair of rectangular projections 20a extending from the underside thereof in registry with the rectangular recesses 7d formed on the bottom plate 7e of the manual feed tray 7. Before the manual feed tray 7 is attached to the guide 19, the adapters 20 are attached to the interior sides of the side walls 7a of the tray 7, as best shown in FIG. 3, the projections 20a being fitted into respective recesses 7d. When the manual feed tray 7 is attached to the guide 19, the top portion of the adapters 20 are each fitted into the groove formed betwen the interior side of the side walls 7a of the tray 7 and the longitudinaly extending projections 19f formed on the underside of the horizontal extensions 19d of the guide 19. Thus, the lateral position of the sheet of manually fed paper on the tray 7 is determined by the interior side surfaces of the adapters 20, as shown in FIG. 3, wherein the position of the sheet of paper on the manual feed tray 7 is indicated by a dot and dash line 16a.

Figure 1:
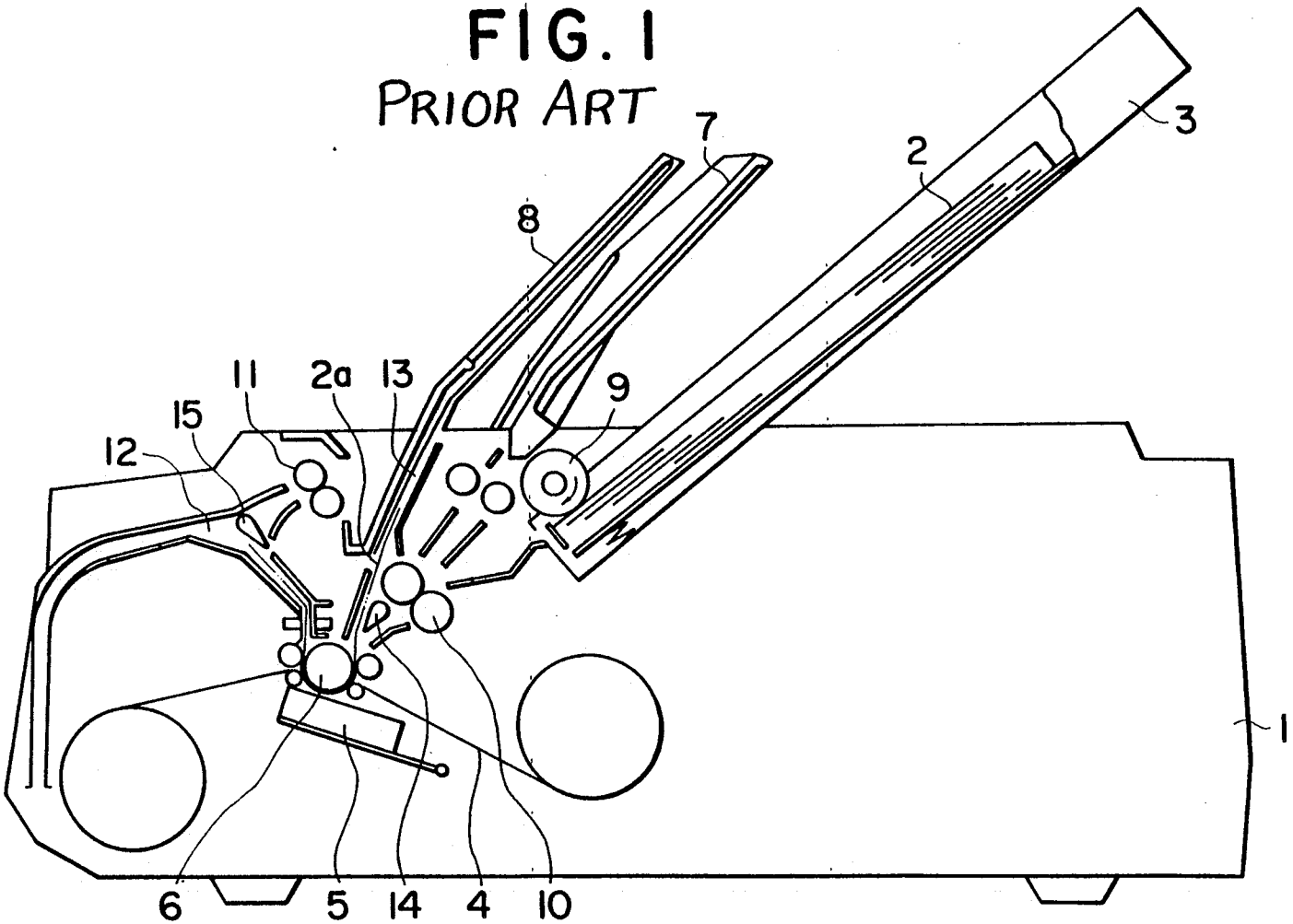
FIG. 1 PRIOR ART
FIG. 1 is a sectional side view of a conventional printer comprising trays formed separately of each other.

When the above described tray assembly is mounted to the printer of FIg. 2, the sheet of paper fed from the manual feed tray 7 is forwarded toward the roller platen 6 by the forwarding rollers 10. Then it is held, together with an ink sheet 4, between the thermal head 5 and the platen roller 6. In a printing operation, the platen roller 6 rotates forward (i.e. clockwise in FIG. 2) and the sheet of paper 2a under printing is moved gradually forward into the front paper passage 12. After each printing of a primary color, the thermal head 5 is raised from the platen 6, and the sheet of paper 2a is moved backward by the platen 6 rotating in the reverse direction. Thus, the sheet 2a is returned to the print starting position, the front end of the sheet of paper 2a entering, via the return passage 13, into the guide 19 of the tray assembly of FIGS. 3 and 4. Thereafter, the printing of the next primay color is effected in manner similar to the above. When the printing of all the primay colors are finished, the sheet of paper 2a is discharged to the discharge tray 8 by the discharge rollers 11. Otherwise than above, the operation of the printer of FIG. 2 provided with the tray assembly of FIGS. 3 and 4 is similar to that of the printer of FIG. 1 described above.

While I have described and shown the particular embdiment of my invention, it will be understood that many modifications may be made without departing from the spirit thereof; I contemplate by the appended claims to cover any such modifications as fall within the true spirit and scope of my invention.

What is claimed is:

1. A tray assembly of a printer wherein a sheet of paper under printing is moved forward in a printing process and backward in a paper returning process, the printer including a return paper passage into which the sheet of paper under printing enters when the sheet of paper is moved backward, said tray assembly comprising:

a discharge tray which receives the sheet of paper which has finished printing operations;

a paper guide formed under said discharge tray to be integral therewith, said paper guide forming an extension of said return paper passage of the printer;

a manual feed tray detachably attached to an underside of said paper guide and having a pair of side walls; and a pair of plate-shaped adapters detachably attached to interior side surfaces of said side walls of said manual feed tray, wherein interior side surfaces of said plate-shaped adapters determine a lateral position of a sheet of paper fed into the printer from said manual feed tray.

2. A tray assembly of a printer as claimed in claim 1, wherein said discharge tray and paper guide have integral side walls, and the paper guide includes a pair of horizontal extensions extending from undersides of the side walls horizontally inward toward each other, the side walls and the horizontal extensions of the paper guide each forming at each side an L-shaped extension of the side walls of the discharge tray.

3. A tray assembly as claimed in claim 2, wherein said side walls of the manual feed tray each have projections extending upward from a top surface thereof, and said horizontal extensions of the paper guide each have holes extending vertically therethrough in registry with said projections, said projections on the side walls of the manual feed tray being fitted into said holes in the horizontal extensions of said paper guide when the manual feed tray is attached to the paper guide.

4. A tray assembly as claimed in any one of the claims 1 through 3, wherein said side walls of the manual feed tray are formed a predetermined distance laterally inward from lateral sides of a bottom plate of the manual feed tray, and portions of said bottom plate of the manual feed tray situated laterally outside of the side walls of the manual feed tray having stepped holes extending vertically therethrough, the paper guide having dowels with a hook-shaped top which extend downward in registry with said stepped holes, the hook-shaped top of the dowels engaging with the stepped holes when said manual feed tray is attached to the paper guide.

5. A thermal transfer type printer comprising:

a thermal transfer printing mechanism which moves a sheet of paper under printing operations forward in a printing process and backward in a paper returning process;

a return paper passage into which the sheet of paper under printing enters when the sheet of paper is moved backward;

a discharge tray which receives the sheet of paper which has finished printing operations;

a paper guide formed under said discharge tray to be integral therewith, said paper guide forming an extension of said return paper passage of the printer;

a manual feed tray detachably attached to an underside of said paper guide and having a pair of side walls; and a pair of plate-shaped adapters detachably attached to interior side surfaces of said side walls of said manual feed tray, wherein interior side surfaces of said plate-shaped adapters determine a lateral position of a sheet of paper fed into the printer from said manual feed tray.

6. A thermal transfer type printer as claimed in claim 5, further comprising a paper cassette means for automatically feeding sheets of paper one by one to said thermal transfer printing mechanism.

* * * * *